United States Patent [19]

LaSpesa

[11] Patent Number: 4,514,100

[45] Date of Patent: Apr. 30, 1985

[54] MOUNTING APPARATUS FOR DOT MATRIX PRINT HEAD

[75] Inventor: Richard E. LaSpesa, Chicago, Ill.

[73] Assignee: AT&T Teletype Corporation, Skokie, Ill.

[21] Appl. No.: 524,518

[22] Filed: Aug. 19, 1983

[51] Int. Cl.[3] ..... B41J 3/10

[52] U.S. Cl. ..... 400/55; 400/175; 400/352; 400/353

[58] Field of Search ..... 400/55, 56, 57, 58, 400/59, 174, 175, 352, 353, 354.3, 355, 356, 357, 358

[56] References Cited

U.S. PATENT DOCUMENTS

| | | | |
|---|---|---|---|
| 3,759,359 | 9/1973 | Stellmach | 400/124 |
| 3,960,256 | 6/1976 | Bickoff | 400/124 |
| 4,023,662 | 5/1977 | Perucca | 400/57 |
| 4,086,997 | 5/1978 | Wu | 400/57 |
| 4,178,106 | 12/1979 | Mailer | 400/57 |
| 4,381,896 | 5/1983 | Shiurila | 400/352 |
| 4,426,165 | 1/1984 | Irro | 400/57 |

*Primary Examiner*—Edgar S. Burr
*Assistant Examiner*—David A. Wiecking
*Attorney, Agent, or Firm*—A. A. Tirva

[57] ABSTRACT

Apparatus for mounting a print head on a movable carriage which moves the print head across a record medium supported by a platen. The apparatus includes a projection extending from the front portion of the carriage, an opening in the print head arranged to accommodate the projection aligning the print head with respect to the platen, a compression spring maintaining the projection in the opening and a movable camming surface in contact with the projection for positioning the print head a variable distance away from the platen.

6 Claims, 9 Drawing Figures

FIG. 2
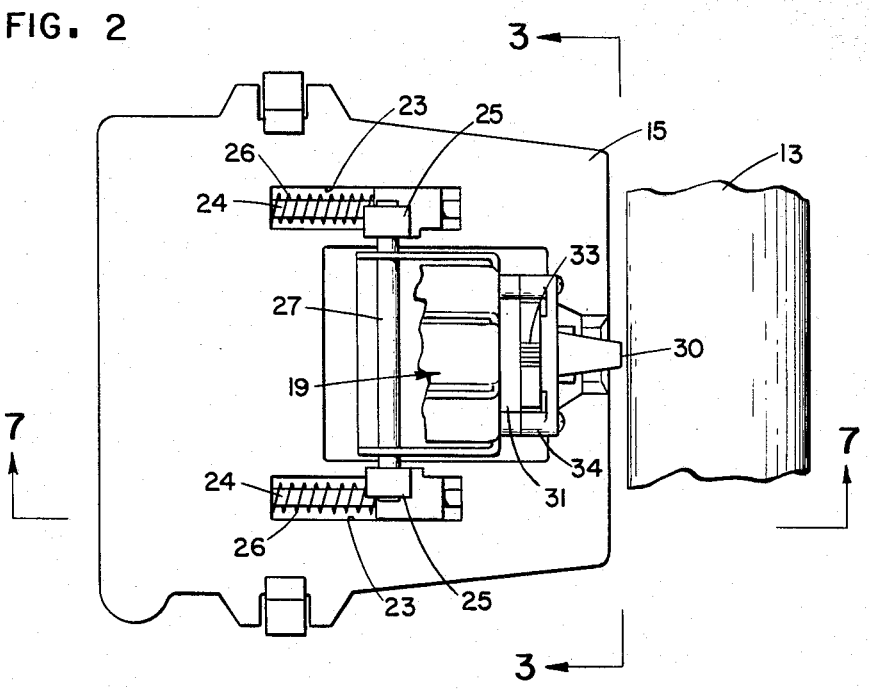
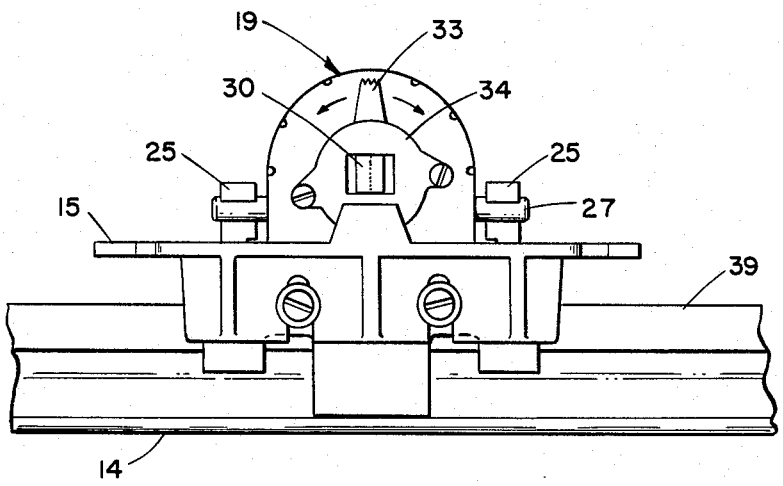
FIG. 3

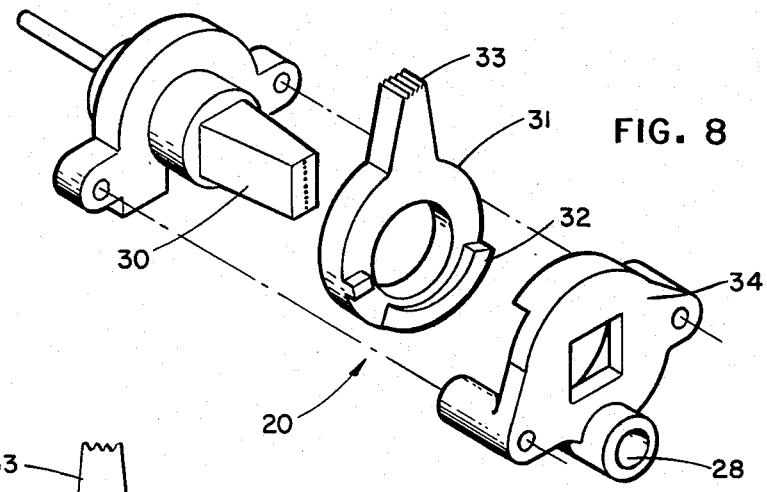
FIG. 8
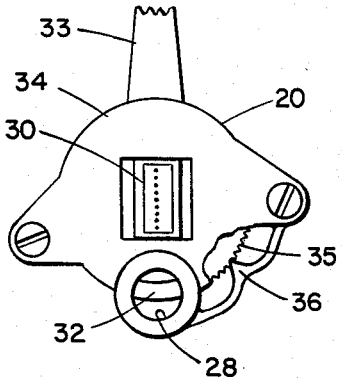
FIG. 9
FIG. 7
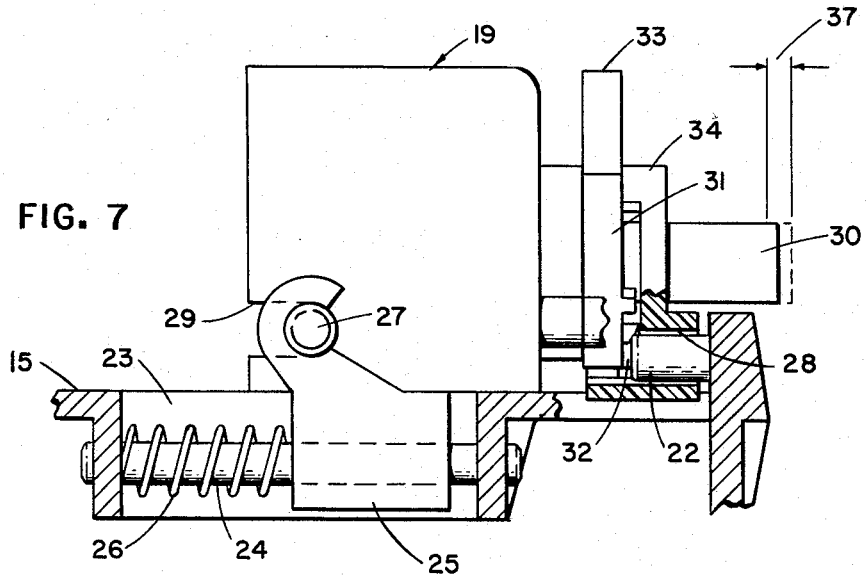

MOUNTING APPARATUS FOR DOT MATRIX PRINT HEAD

DESCRIPTION

1. Technical Field

This invention relates to dot matrix printers and more particularly to an improved mounting apparatus for a print head used in such printers.

2. Background Art

Dot matrix printers are well-known in the art. Such printers generally include a dot matrix print head mounted on a carriage which, in turn, is slidably mounted on guideways which allow lateral movement of the carriage parallel to the platen. Each printer also has paper handling apparatus allowing either single sheets of paper or continuous paper to be fed around the platen.

The print head includes a plurality of wires, each wire having an end connected to an actuator which when energized causes the wire to move forward. The free ends of the wires are aligned in a vertical line and are positioned close to the platen. A printer ribbon is located between the free ends of the wires and the paper, so that when an actuator is energized the wire connected to it moves forward and strikes the ribbon against the paper leaving a jot on the paper. By appropriate lateral movement of the print head and selective energizing of the actuators, characters can be printed on the paper in a well-known manner.

For changing the printer ribbon, feeding new paper into the printer, or replacing the print head because of worn print wires or other problems, the print head has to be easily removable and a new print head has to be just as easily and quickly mountable. It is important that after such operations the print wires be repositioned relative to the platen to maintain the established printing gap and thus ensure uniformity of printing. Additionally, to accommodate paper of varying thickness, the print head should be movable along an axis perpendicular to the path of travel to the carriage to permit the printing gap to be adjusted.

Various print head mounting arrangements incorporating mechanisms for adjusting the position of a print head with respect to a platen are known in the prior art. All of the knwon mounting and adjusting mechanisms are complex, difficult to operate, not easily manufacturable, and thus overall expensive. The present invention overcomes these drawbacks.

DISCLOSURE OF THE INVENTION

In accordance with the present invention, I provide an apparatus for releasably mounting a print head on a carriage movably mounted in a printer. The apparatus includes a cylindrical projection extending from the front portion of the carriage, the print head having a cylindrical opening arranged to receive the cylindrical projection aligning the head relative to a platen, a rotatable cam surface for engaging the end of the projection and positioning the print head a predetermined distance away from a platen, and a spring for maintaining the cylindrical projection in the bore and against the cam surface.

DRAWING

FIG. 2 shows a plan view of a carriage and a print head mounted on the carriage shown in FIG. 1.

FIG. 3 is a right end illustration taken along line 3—3 of FIG. 2.

Figure 1:
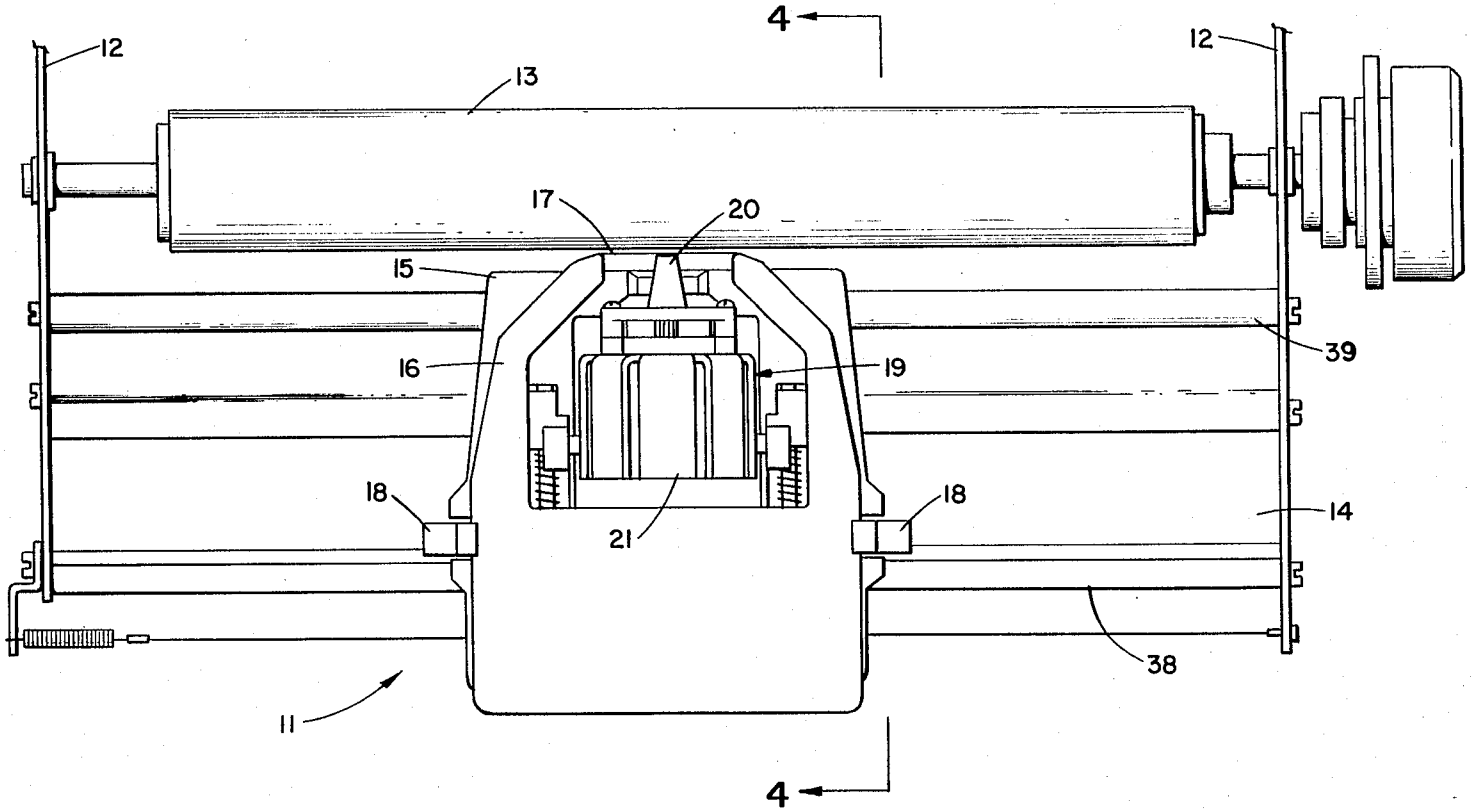
FIG. 1 shows a plan view of a dot matrix print head mounted in a printer in accordance with the invention.
Figure 4:
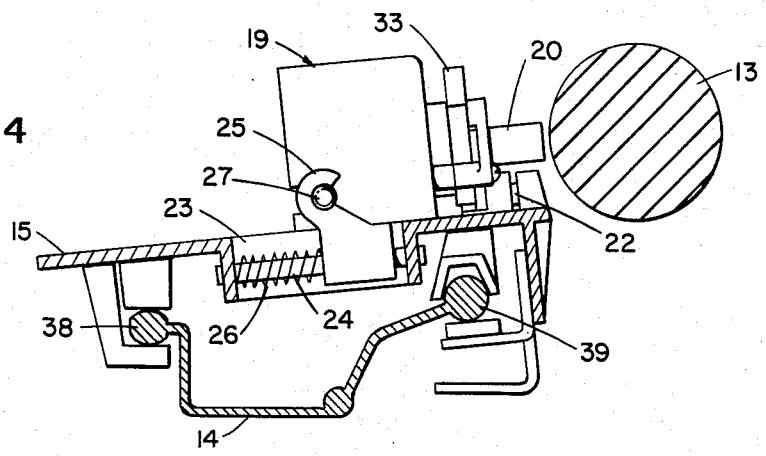
Figure 5:
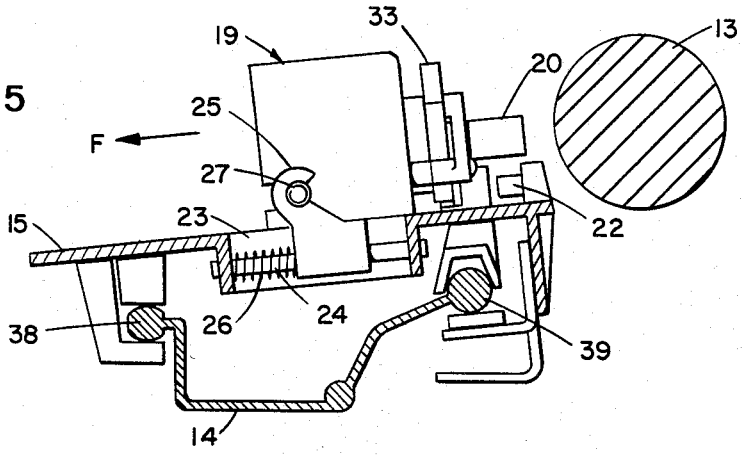
Figure 6:
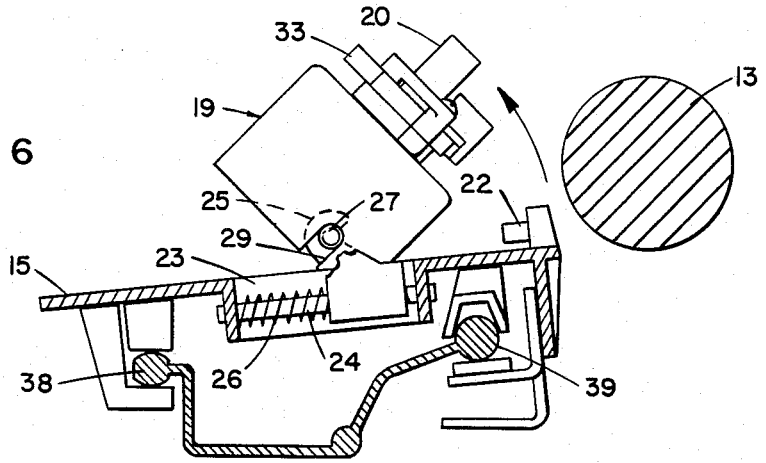

FIGS. 4, 5, and 6 are cross-sectional views taken along line 4—4 of FIG. 1 and illustrate the mounting arrangement of the print head on the carriage.

FIG. 7 is a cross-sectional view of the print head mounting arrangement taken along line 7—7 of FIG. 2.

FIG. 8 shows an exploded perspective view of the nose portion of the print head.

FIG. 9 shows the front view of the assembled nose portion of the print head shown in FIG. 7.

DETAILED DESCRIPTION

FIG. 1 shows a partial top view of a matrix printer 11 having end panels 12 supporting a platen 13. End panels 12 are held together by a guide structure 14 having guide rails 38 and 39 upon which carriage 15 is slidably mounted. A ribbon cartridge 16 containing a printer ribbon 17 is mounted on the carriage 15 and is held in place by two latches 18. A print head 19 having a nose portion 20 and a tail portion 21 is also mounted on the carriage 15. The print head 19 contains a plurality of electrically energizable print wires (not shown) for movement towards the platen 13. The carriage 15 is driven across a line of type on a record medium, which is not shown in FIG. 1 but which is customarily positioned between the platen 13 and the printer ribbon 17. During this movement of the carriage 15, the individual print wires are actuated to impact the record medium through the printer ribbon 17. The mechanisms for driving the carriage 15 and operating the individual print wires are well-known in the art and need not be discussed in further detail.

Mounting of the print head 19 on the carriage 15 is illustrated in FIGS. 2 through 9. To simplify the illustration the ribbon cartridge 16 is omitted from the FIGS. 2 through 9. The carriage 15 has a cylindrical projection 22 extending from the front portion of the carriage 15 in a direction substantially perpendicular to the path of travel of the carriage 15 and towards the back portion of the carriage 15 (FIGS. 5–7). Additionally, the carriage 15 has two parallel rectangular openings 23 with their major axes positioned perpendicular to the path of travel of the carriage 15 (FIGS. 2 and 7). A cylindrical guide rod 24 is mounted in each opening 23 so that the longitudinal axis of each rod 24 is aligned with the major axis of the respective opening 23. A body 25 having a rectangular shape and dimensions to slidably fit in the opening 23 is slidably mounted on each guide rod 24. A compression spring 26 located in each opening 23 biases each body 25 towards the front portion of the carriage 15. A cylindrical member 27 having its longitudinal axis parallel to the path of travel of the carriage 15 connects the two bodies 25.

The nose portion 20 of the print head 19 has a cylindrical opening 28 which is arranged to accept the cylindrical projection 22 thereby aligning nose section 20 and the print wires contained therein along an axis perpendicular to the path of travel of the carriage 15 (FIGS. 7–9). The tail portion 21 of the print head 19 has an opening 29 arranged to accept the cylindrical member 27 whereby the force developed by the springs 26 and applied through the bodies 25 pushes the print head 19 towards the platen 13 and maintains the cylindrical projection 22 in the cylindrical opening 28.

To remove the print head 19 from the carriage 15, a force F, as shown in FIG. 5, of sufficient magnitude to overcome the force developed by the springs 26 is applied to the print head 19 enabling the cylindrical projection 22 to move clear of the cylindrical opening 28 and allowing print head 19 to be pivoted around member 27, as shown in FIG. 6. Force F is then decreased allowing bodies 25 to move in their respective openings 23 towards the front portion of the carriage 15. At this point the print head 19 can be lifted from the carriage 15.

Referring now to FIG. 8, there is shown an exploded perspective view of the nose portion 20 of the print head 19. The nose portion 20 has a first section 30 for guiding the plurality of print wires (not shown), a collar 31 rotatably mounted on the first guide section 30, and a second section 34 which contains the cylindrical opening 28. The collar 31 has a cam surface 32 and a tab 33 for rotating the collar 31. In the assembly of the nose portion 20, as shown in FIGS. 7 and 9, the cam surface 32 is positioned directly behind the cylindrical opening 28. When the print head 19 is mounted on the carriage 15, the cylindrical projection 22 passes through the cylindrical opening 28 and butts up against the cam surface 32. Rotation of the collar 31 via tab 33 positions a different portion of the cam surface 32 behind the opening 28 controlling the travel of the projection 22 through the opening 28 and thus positioning the print head 19 either closer or farther away from the platen 13. By varying the length of the cylindrical projection 22 and the rotation of the cam surface 32, a desired printing gap 37 range can be easily established (FIG. 7). A plurality of notches 35 located on the collar 31 are engaged by a detent spring 36, located on the second section 34, locking the the print head 19 in place after the desired spacing between the print head 19 and the platen 13 is established.

What is claimed is:

1. Apparatus for releasably mounting a dot matrix print head on a carriage located in a printer and arranged to move the print head laterally across a record medium supported on a platen rotatably mounted in the printer, the carriage having a front and back portion, the front portion positioned near the platen, the apparatus comprising:

a cylindrical projection extending from the front portion of the carriage towards the back portion, the projection having its longitudinal axis substantially perpendicular to the path of travel of the carriage;

the print head having a nose portion and a tail portion and containing a plurality of actuatable print wires having their printing ends located in the nose portion;

the nose portion having a cylindrical opening extending therethrough, the opening arranged to slidably receive the cylindrical projection such that the end of the projection enters through the first end of the opening and after passing through the entire length of the opening exits through the second end of the opening;

a rotatable camming surface positioned behind the second end of the opening so that the end surface of the projection butts up against a portion of the camming surface;

means for rotating the camming surface; and means for applying a force to the print head to maintain the projection in the opening and against the camming surface.

2. Apparatus in accordance with claim 1 wherein rotation of the camming surface moves the projection axially through the opening.

3. Apparatus for releasably mounting a dot matrix print head on a carriage located in a printer and arranged to move the print head laterally across a record medium supported on a platen rotatably mounted in the printer, the carriage having a front and a back portion, the front portion positioned near the platen, the apparatus comprising:

a cylindrical projection extending from the front portion of the carriage towards the back portion, the projection having its longitudinal axis substantially perpendicular to the path of travel of the carriage;

the print head having a nose portion and a tail portion and containing a plurality of actuatable print wires;

the nose portion comprising a first section having a plurality of apertures therein each aperture arranged to accommodate a respective printing wire;

a collar rotatably mounted on the first section, the collar encompassing the printing wires;

a camming surface located on one end face of the collar;

a second section having a cylindrical opening extending therethrough adapted to slidably accommodate the cylindrical projection, the second section mounted to the first section so that the collar is between the first and second sections and such that a portion of the camming surface is positioned directly opposite the cylindrical opening;

the cylindrical projection having a length so that the end portion of the projection passes through the cylindrical opening and butts up against the camming surface;

means for rotating the collar; and means for applying a force to the print head for maintaining the end of the projection against the camming surface.

4. Apparatus in accordance with claim 3 wherein the means for applying a force to the print head comprises:

a pair of guide members mounted on the carriage, each guide member having its major axis substantially perpendicular to the line of travel of the carriage;

a pair of bodies, each body slidably mounted on its respective guide member;

a rigid member having its major axis substantially parallel to the line of travel of the carriage joining the two bodies;

the tail portion of the print head having a slot adapted to receive the joining member; and a pair of compression springs located on the carriage, each spring biasing one of the bodies towards the front portion of the carriage for maintaining the member joining the two bodies in engagement with the print head.

5. Apparatus in accordance with claim 4 wherein the means for applying a force to the print head includes:

the carriage having two substantially elongated openings parallel to each other, each opening having its major axis substantially perpendicular to the line of travel of the carriage; and each body slidably mounted on a guide member having a portion with a shape which is slidably accommodated by a respective elongated opening.

6. Apparatus in accordance with claim 5 wherein each of the guide members is located in its respective elongated opening.

* * * * *